US006634872B1

(12) United States Patent
Bougamont et al.

(10) Patent No.: US 6,634,872 B1
(45) Date of Patent: Oct. 21, 2003

(54) SUCTION PUMP

(75) Inventors: Jean-Louis Bougamont, Eu (FR); Christophe Roy, Dieppe (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/926,178

(22) PCT Filed: Mar. 21, 2000

(86) PCT No.: PCT/FR00/00700

§ 371 (c)(1),
(2), (4) Date: Nov. 20, 2001

(87) PCT Pub. No.: WO00/56465

PCT Pub. Date: Sep. 28, 2000

(30) Foreign Application Priority Data

Mar. 22, 1999 (FR) ..... 99 03511

(51) Int. Cl.[7] ..... F04B 39/10; F04B 53/12
(52) U.S. Cl. ..... 417/549; 222/321.9
(58) Field of Search ..... 417/579, 510, 417/511, 512, 549; 222/382, 384, 153, 183, 207, 321.9, 321.2, 321.7; 92/34, 36, 89, 90

(56) References Cited

U.S. PATENT DOCUMENTS 3,362,344 A * 1/1968 Duda ..... 103/188
3,399,836 A * 9/1968 Pechstein ..... 239/333
3,583,605 A * 6/1971 Corsette ..... 222/321
3,923,250 A * 12/1975 Boris ..... 239/321
4,087,025 A * 5/1978 Steiman ..... 222/321
4,434,916 A * 3/1984 Ruscitti et al. ..... 222/321
5,271,532 A * 12/1993 Jumel et al. ..... 222/321

FOREIGN PATENT DOCUMENTS

JP 0 757 004 A1 * 2/1997

* cited by examiner

*Primary Examiner*—Charles G. Freay
*Assistant Examiner*—Han L Liu
(74) *Attorney, Agent, or Firm*—Bacon & Thomas, PLLC

(57) ABSTRACT

The invention relates to a pump of the type comprising a cylindro-conical body (1) defining a metering chamber (10) closed at its bottom portion by an inlet valve (11) and at its top portion by a moving piston (2) co-operating with resilient return means (3) while being carried axially by a nozzle tube (4) having a top end that projects outside the pump body and having a bottom end that is provided with at least one delivery orifice (40), the pump being characterized in that said piston (2) is slidably mounted firstly about the tube (4) between a closure position closing the delivery orifice (40) and an open position in which said orifice is fully open, and secondly in sealed peripheral contact with the inside wall of said chamber (10) between a top end-of-stroke abutment and a bottom end-of-stroke abutment; the coefficient of friction between the piston (2) and the tube (4) being less than the coefficient of friction between said piston (2) and the inside wall of the body (1).

6 Claims, 4 Drawing Sheets

SUCTION PUMP

BACKGROUND OF THE INVENTION

1. Field of the Invention

The present invention relates to a pump and more particularly a pump for liquid cosmetic substances of the cream type.

2. Related Art

Conventional pumps comprise a cylindro-conical body defining a metering chamber closed at its bottom portion by an inlet valve and at its top portion by a moving piston co-operating with resilient return means while being carried axially by a nozzle tube having a top end that projects outside the pump body and having a bottom end that is provided with at least one delivery orifice.

Such pumps are designed to be fitted to containers such as bottles and the assembly as a whole thus forms a packaging and dispensing system.

Such pumps are described in particular in EP 0 888 824 and EP 0 757 004 in which the piston is also slidably mounted firstly about the nozzle tube between a closure position closing the delivery orifice and an open position in which said orifice is fully open, and secondly in sealed peripheral contact with the inside wall of said chamber between a top end-of-stroke abutment and a bottom end-of-stroke abutment; the coefficient of friction between the piston and the tube being less than the coefficient of friction between said piston and the inside wall of the body.

However, certain cosmetic substances have a naturally tendency to dry out when exposed to air. Consequently, any substance that has not been expelled and that remains in the nozzle tube between two uses is capable of creating an artificial plug which can subsequently hinder or prevent the substance from being dispensed.

BRIEF SUMMARY OF THE INVENTION

An object of the present invention is to resolve this technical problem in satisfactory manner.

The invention achieves this object by means of a pump of the above-mentioned type characterized in that the bottom end-of-stroke abutment of the piston in the chamber is formed by ribs that extend along the wall of said chamber parallel to the generator lines of said body, and in that said piston is constituted by a central sleeve that surrounds the nozzle tube, having an inside wall that has a top recess defining an annular bottom, and that is extended radially outwards by a peripheral ring via a connecting spacer, the stroke of the piston over the tube being upwardly limited by abutment of the bottom of said recess against the bottom circumference of a projection of complementary profile secured to said tube.

According to an advantageous characteristic, the stroke of the piston over the nozzle tube is determined in such a manner that, when the tube rises, a volume of substance corresponding to the residue contained in said tube is sucked back into the chamber.

According to another characteristic, the resilient return means act on the bottom end of the nozzle tube which extends inside the metering chamber.

In a specific embodiment, the top abutment of the piston is formed by the bottom inside edge of a collar covering the top portion of the body and ensuring that the nozzle tube is held.

In yet another embodiment, the closure position of the delivery orifice corresponds to the piston being in contact with the projecting annular rim of a tip fitted over at least part of the bottom end of said tube beneath the level of said orifice and receiving thrust from the return means.

In a variant, the projecting rim has a tapering inside profile co-operating with the beveled bottom edge of the piston so as to ensure that the delivery orifice is closed in sealed manner.

The pump of the invention enables the nozzle tube to be cleared automatically of any substance after each delivery.

Thus, all the components of the dispensing head (nozzle tube, pushbutton, nozzle, . . . ) are always cleaned and all of the substance is contained in spaces that are closed and isolated from the outside.

The pump of the invention therefore ensures sealed and protective confinement for the substance, thereby preserving its quality and its intrinsic properties.

DESCRIPTION OF THE DRAWINGS

The present invention will be better understood on reading the following description with reference to the accompany drawings, in which.

DETAILED DESCRIPTION OF PREFERRED EMBODIMENTS

Figure 1:
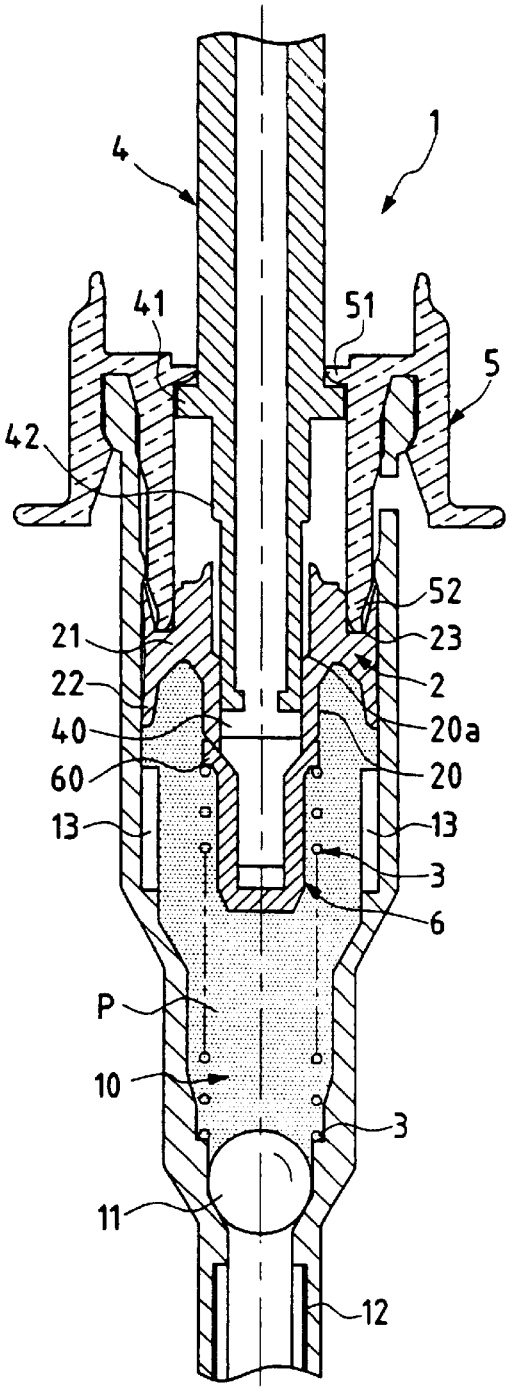
FIG. 1 is a section view of an embodiment of the pump of the invention during a rest stage.

The pump shown in the figures comprises a cylindro-conical body 1 internally defining a metering chamber 10. The chamber 10 is closed at its bottom portion by an inlet ball valve 11 and is extended downwards by a plunger tube 12.

The body of the pump is designed to be inserted, at least in part, inside a receptacle such as a bottle (not shown) where the tube 12 is immersed in the liquid substance to be dispensed.

The chamber 10 is closed at its top portion by a moving piston 2 housed inside the chamber and co-operating with resilient return means. In this case, the resilient return means are constituted by a helical spring 3 mounted inside the chamber 10. The piston 2 is carried by the bottom portion of a nozzle tube 4 having a top end that projects outside the body 1 and that is capped by a pushbutton (not shown).

The bottom end of the nozzle tube 4 is provided with an outlet valve including, in particular, one or more orifices 40 opening out laterally. The spring 3 is disposed between the bottom end of the nozzle tube 4 and the bottom of the chamber 10 above the ball 11.

A collar 5 covers the top portion of the body 1 both to retain the nozzle tube 4 and also to mount the pump on the receptacle.

The piston 2 is slidably mounted firstly about the nozzle tube 4, and secondly in sealed peripheral contact with the inside wall of the chamber 10.

The piston 2 is constituted by a central sleeve 20 that surrounds the tube 4 and that is extended radially outwards by a peripheral ring 22 via a connecting spacer 21.

The inside wall of the sleeve 20 has a top recess defining an annular bottom 20*a* designed to co-operate with a shoulder formed by a projection 42 secured to the side wall of the tube 4 and having a bottom circumference 42*a* of profile complementary to the bottom 20*a*.

The piston 2 is capable of being displaced relative to the nozzle tube 4 between a position in which it closes the outlet valve by closing the orifice 40, and a fully-open position of said valve in which it frees said orifice.

In general, the stroke of the piston 2 over the tube 4 is upwardly limited by abutment of the bottom 20*a* of the recess of the sleeve 20 against the bottom circumference 42*a* of the projection 42, and downwardly limited by the beveled bottom edge of said sleeve bearing against the inside face of the projecting annular rim 60 of a tip 6 which fits over at least part of the bottom end of the tube 4 beneath the level of the orifice 40. To this end, the inside face of the rim 60 has a tapering profile which co-operates in sealed manner with the beveled bottom edge of the sleeve 20. The projecting rim 60 also has an outside face against which the top end-turn of the spring 3 is thrust and wedged.

The tube 4 is itself retained in the body of the pump by means of an annular shoulder 41 that is capable of coming into abutment upwards against a circular lip 51 of the collar 5.

In addition, the piston 2 is also capable of being displaced axially in the chamber 10 relative to the body of the pump by compressing the substance.

Figure 2:
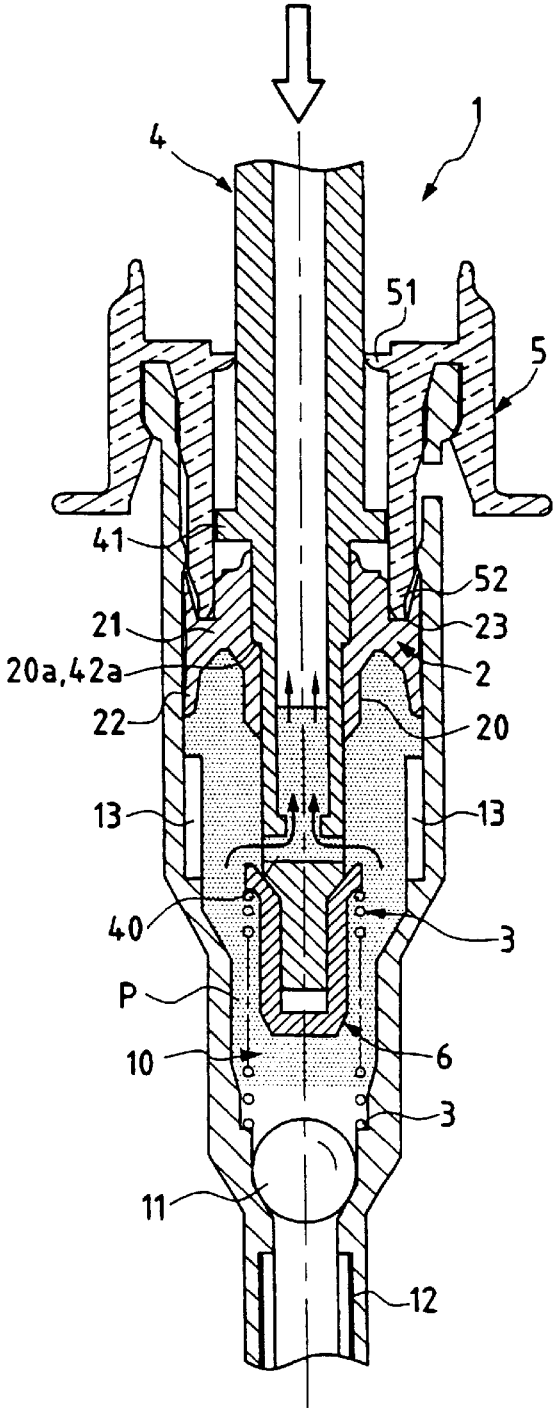
FIG. 2 is a section view of the pump of FIG. 1 during an initial stage of delivery.

From the rest position in FIG. 1, manually pressing the top end of the nozzle tube 4 or a pushbutton (not shown) capping said tube causes the tube 4 to slide through the sleeve 20 to the bottom position shown in FIG. 2. In this position, the projection 42 is thus engaged in the recess of the sleeve 20. The coefficient of friction between the outside wall of the tube 4 and the inside wall of the sleeve 20 is selected to be less than the coefficient of friction between the side wall of the ring 22 and the inside wall of the chamber 10. The difference between the coefficients of friction of the piston relative to the wall of the chamber 10 and to the tube 4 respectively is obtained, for example, by modifying the surface state, or preferably by adjusting the contact areas.

The descent of the tube 4 into the chamber 10 is accompanied by compression of the spring 3 and frees the orifice 40, thereby causing a small escape of substance into the inside duct of the tube despite its narrow section.

Figure 3:
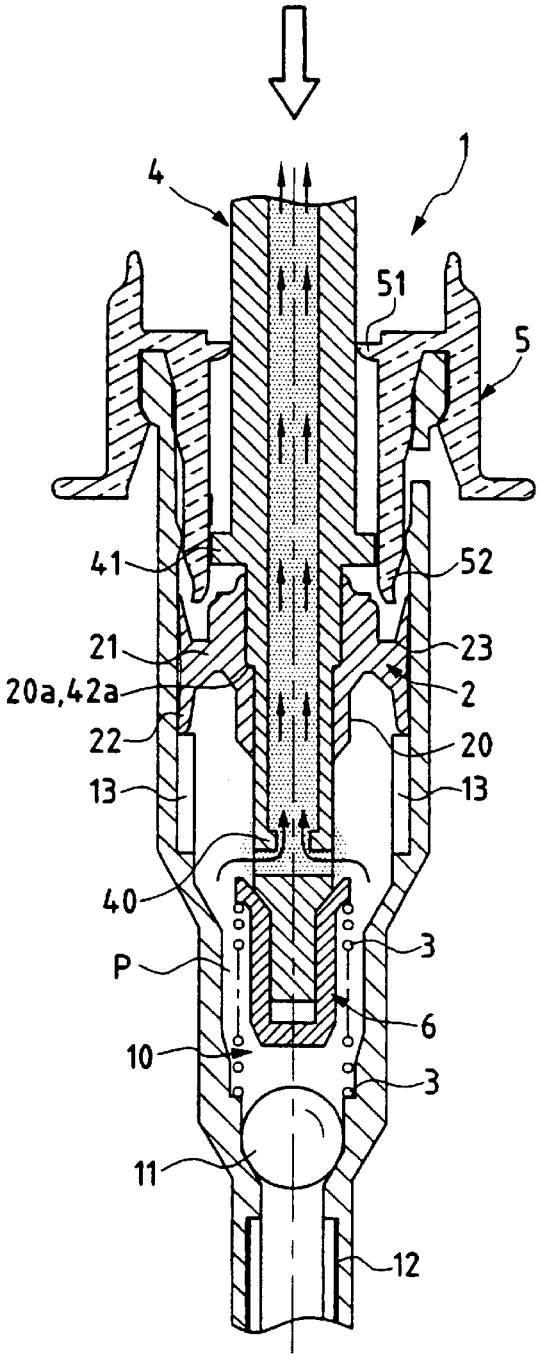
FIG. 3 is a section view of the pump of FIG. 1 during a final stage of delivery.

From this precompressed position, following the manual press, the piston 2 descends into the chamber 10 until it reaches the bottom end-of-stroke abutment constituted in this case by ribs 13 that extend along the wall of the chamber 10 parallel to the generator lines of the body 1. This second stage shown in FIG. 3 finalizes the metered delivery of the substance and leads to the chamber 10 being emptied.

From this position, the nozzle tube 4 can automatically move back up under the action of the spring 3. This takes place firstly through the sleeve 20 of the piston 2 which remains fixed in a bottom position inside the chamber 10 as a result of the resistance to displacement of the ring 22 in friction contact with the wall of the chamber.

Figure 4:
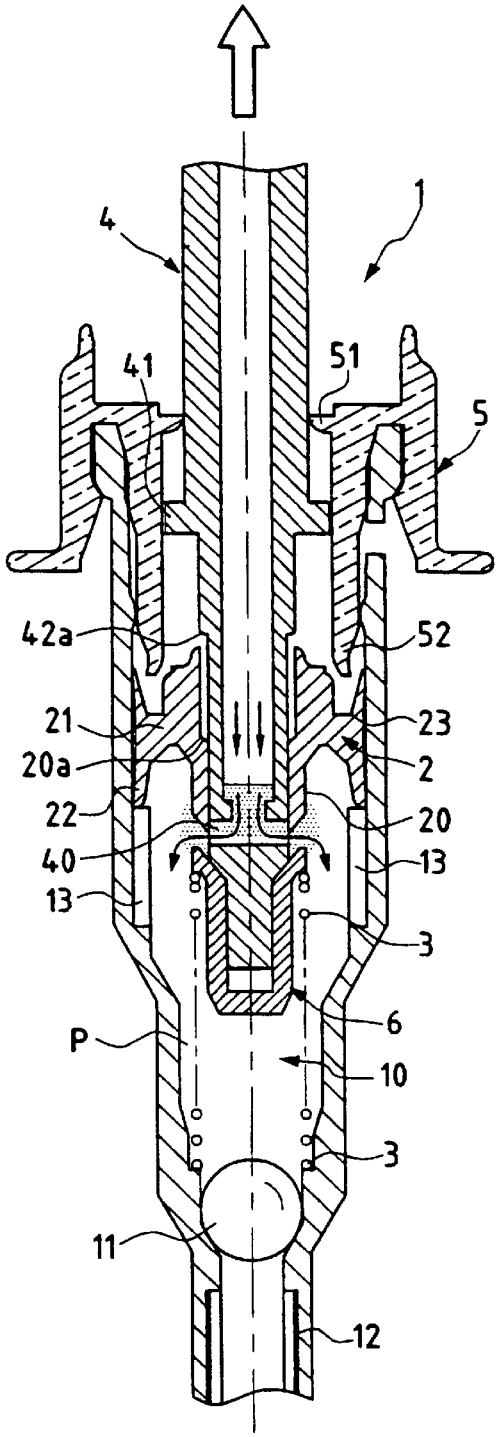
FIG. 4 is a section view of the pump of FIG. 1 during a suck-back stage.

The up stroke of the tube 4 is accompanied by the remaining substance contained in the tube being sucked back into the chamber 10 via the orifice 40, as shown in FIG. 4.

Figure 5:
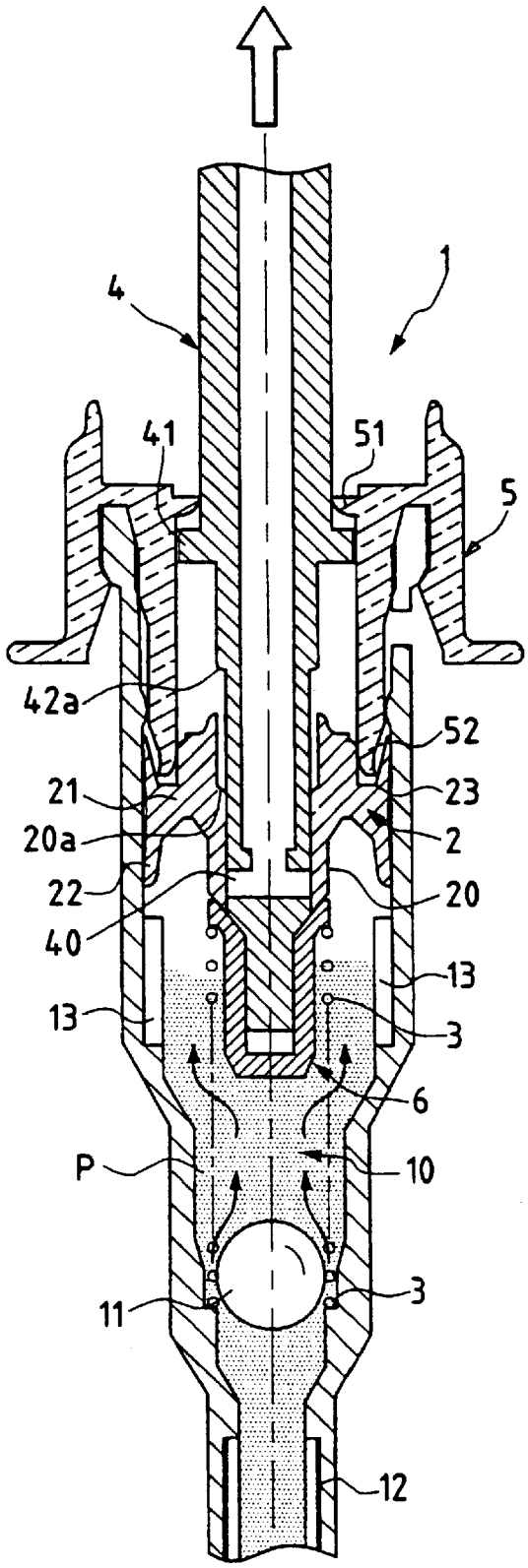
FIG. 5 is a section view of the pump of FIG. 1 during a stage of filling the pump.

When the projecting rim 60 of the tip 6 comes into contact with the bottom edge of the sleeve 20, the orifice 40 is closed and the stroke of the tube 4 thus entrains the piston 2 upwards until it comes into abutment against the bottom inside edge 52 of the collar 5 forming the top abutment as shown in FIG. 5. During this stage, substance P is extracted from the receptacle via the tube 12 and the outlet valve 11, and thus fills the chamber 10.

The piston 2 preferably includes a top neck 23 formed in the spacer 21 and designed to receive the bottom inside edge 52 of the collar 5 which, at this level, extends away from the wall of the body 1.

Figure 6A:
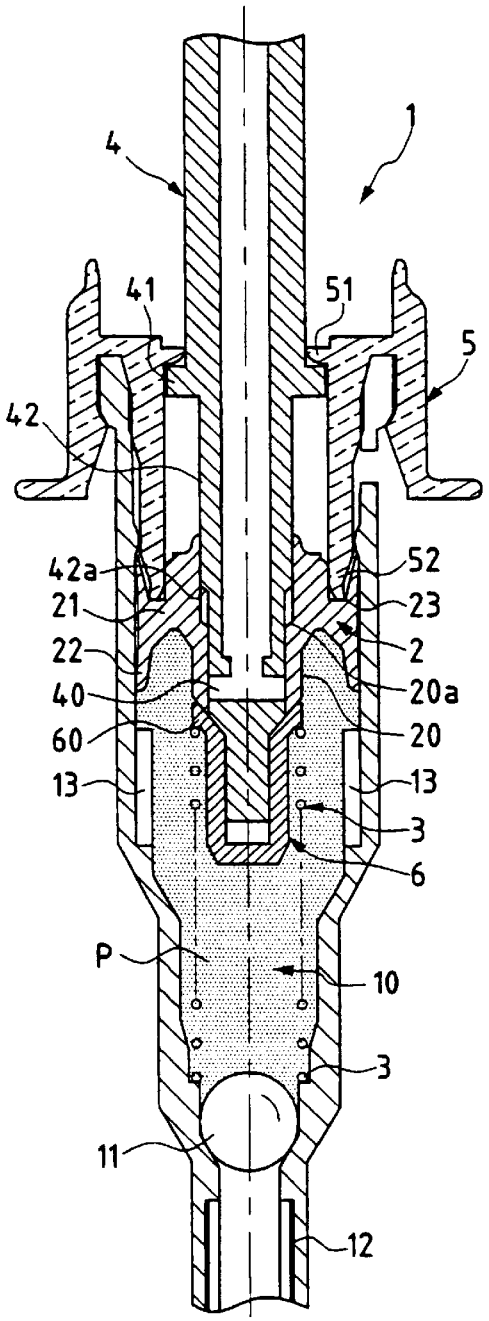
FIGS. 6A and 6B are section views of a variant embodiment of the pump of the invention in positions corresponding respectively to FIGS. 1 and 4.
Figure 6B:
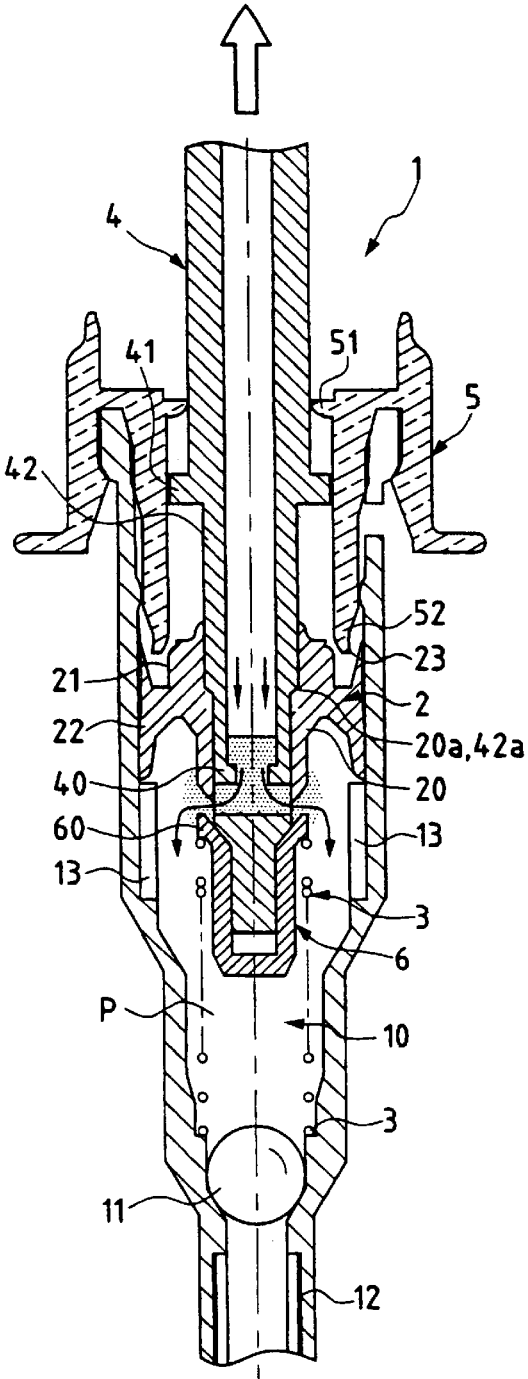

In the variant shown in FIGS. 6A and 6B, the stroke of the piston 2 relative to the tube 4 is restrained, thereby causing a minimum-volume suck-back stage (FIG. 6B).

Furthermore, in this variant, the bottom circumference 42*a* of the projection 42 is tapered.

What is claimed is:

1. A pump comprising:

a cylinder conical body defining a metering chamber, said chamber having a bottom, an inlet at the bottom, and an inlet valve controlling flow through the inlet;

a reciprocally movable piston in a top portion of the chamber and slidable in said chamber in peripheral ceiling engagement with an inner wall of the chamber between a top end-of-stroke position and a bottom end-of-stroke position, said end-of-stroke positions defined by respective top and bottom abutments;

said bottom abutment defined by at least one radially projecting rib extending inwardly of the inner wall of the chamber;

the sliding coefficient of friction between the piston and the tube being less than the sliding coefficient of friction between the tube and the inside wall of the chamber;

a nozzle tube having a top end extending out of the chamber and a lower end including at least one delivery orifice, said piston carried by said nozzle tube and slidable relative to the nozzle tube along an outer length of the nozzle tube;

said piston closing said delivery orifice when located at a first longitudinal position on said nozzle tube and exposing said delivery orifice when located at a second longitudinal position on said nozzle tube;

said nozzle tube including a radially extending projection and said piston including an annular recess at its top end area adjacent said nozzle tube, said recess closed by an annular shoulder at its bottom area, said profile extendible into said recess up to said shoulder, so that longitudinal movement of the nozzle tube causes the nozzle tube to slide longitudinally relative to the piston until the profile of the tube engages the annular shoulder of the piston and thereafter continued longitudinal movement of the tube causes the piston to be moved with the nozzle tube in the chamber until said piston reaches its bottom end-of-stroke position defined by said bottom abutment;

said piston being disposed in a delivery orifice opening position after initial downward longitudinal sliding of the nozzle tube relative to said piston in said chamber and up to the piston reaching its bottom end-of-stroke position;

a resilient return element arranged to bias the nozzle tube towards a top discharge orifice closed position within the piston and to urge the tube and piston together towards the piston top end-of-stroke abutment.

2. The pump according to claim 1, wherein said nozzle tube is slidable upwards relative to said piston while said piston is located at its bottom end-of-stroke position, wherein the discharge orifice remains open during such relative sliding movement over a length of said tube.

3. The pump according to claim 1, wherein said resilient return element engages the bottom end of the nozzle tube within said metering chamber.

4. The pump according to claim 1, wherein said top abutment is defined by a bottom inside edge of a collar covering a top portion of said conical body, said collar engaging said nozzle tube and retaining said nozzle tube within said body.

5. The pump according to claim 1, wherein the bottom end area of said nozzle tube includes an annular projecting rim including a tapering inside profile, and said piston includes a beveled bottom edge; said profile and bottom edge engaging each other when the piston is located in the discharge orifice closing position on said nozzle tube.

6. The pump according to claim 5, wherein the engagement between said projecting rim inside profile and said beveled bottom edge of said piston is a sealing engagement.

* * * * *